US008402599B2

(12) United States Patent
Charlton et al.

(10) Patent No.: US 8,402,599 B2
(45) Date of Patent: Mar. 26, 2013

(54) VACUUM CLEANER DIRT CUP AND SEAL

(75) Inventors: Christopher M. Charlton, Medina, OH (US); Raymond P. Kawolics, Macedonia, OH (US)

(73) Assignee: Techtronic Floor Care Technology Limited, Road Town, Tortola (VG)

( * ) Notice: Subject to any disclaimer, the term of this patent is extended or adjusted under 35 U.S.C. 154(b) by 272 days.

(21) Appl. No.: 12/873,990

(22) Filed: Sep. 1, 2010

(65) Prior Publication Data

US 2012/0047681 A1 Mar. 1, 2012

(51) Int. Cl.
*A47L 5/36* (2006.01)

(52) U.S. Cl. ..... 15/352; 15/353; 55/337; 55/430; 55/433; 55/DIG. 3

(58) Field of Classification Search ..... 15/352, 15/353; 55/430, 432, 433, DIG. 3, 337; *A47L 5/36*
See application file for complete search history.

(56) References Cited

U.S. PATENT DOCUMENTS

| | | | | |
|---|---|---|---|---|
| 6,574,826 | B1 | 6/2003 | Turkal | |
| 6,951,045 | B2 | 10/2005 | Thur et al. | |
| 6,991,666 | B2 | 1/2006 | Organ | |
| 7,014,675 | B2 | 3/2006 | Nakai et al. | |
| 7,018,439 | B2 | 3/2006 | Vuijk | |
| 7,175,682 | B2 | 2/2007 | Nakai et al. | |
| 7,186,283 | B2 | 3/2007 | Vuijk | |
| 8,021,453 | B2 * | 9/2011 | Howes | 55/447 |
| 2007/0209144 | A1 | 9/2007 | Fester et al. | |
| 2007/0209147 | A1 | 9/2007 | Krebs et al. | |
| 2007/0209148 | A1 | 9/2007 | Yacobi et al. | |
| 2007/0209150 | A1 | 9/2007 | Gogel et al. | |
| 2008/0086835 | A1 | 4/2008 | Stewen et al. | |
| 2009/0100633 | A1 | 4/2009 | Bates et al. | |
| 2009/0100634 | A1 | 4/2009 | Bates et al. | |

FOREIGN PATENT DOCUMENTS

| | | |
|---|---|---|
| JP | 6-133901 | 5/1994 |
| JP | 2005-261963 | 9/2005 |
| JP | 2006-346489 | 12/2006 |
| KR | 10-2005-0057803 | 6/2005 |

OTHER PUBLICATIONS

PCT/US2011/050153 International Search Report and Written Opinion dated Feb. 9, 2012 (9 pages).

* cited by examiner

*Primary Examiner* — David Redding
(74) *Attorney, Agent, or Firm* — Michael Best & Friedrich LLP

(57) ABSTRACT

A dirt cup for a vacuum cleaner including a container, a tube, a lid, a first chamber, a second chamber, and a seal. The container includes an open bottom end. The lid is coupled to the container. The lid includes an aperture that extends through the lid. The lid is movable between a closed position where the lid covers the open bottom end and an open position for emptying the container through the open bottom end. The seal is coupled to the lid and includes a flange and a post that extends from the flange. The post extends into the aperture of the lid to couple the seal to the lid. The seal is positioned between the lid and the tube when the lid is in the closed position to inhibit airflow between the first chamber and the second chamber.

22 Claims, 7 Drawing Sheets

VACUUM CLEANER DIRT CUP AND SEAL

BACKGROUND

The present invention relates to dirt cups for vacuum cleaners, and more particularly to seals for dirt cups of vacuum cleaners.

A dirt cup is used to collect the dirt, dust, and other debris sucked up or vacuumed by a vacuum cleaner. When the dirt cup fills up with dirt, the user detaches the dirt cup from the vacuum cleaner and empties the collected dirt from the dirt cup. The dirt cup is then reattached to the vacuum cleaner. A vacuum cleaner that uses a dirt cup to collect dirt instead of a replaceable vacuum bag eliminates the need to purchase and replace vacuum bags as each bag fills up with dirt.

SUMMARY

The present invention provides, in one aspect, a dirt cup for use in a vacuum cleaner. The dirt cup includes a container, a tube, a lid, a first chamber, a second chamber, and a seal. The container includes an interior surface and an open bottom end. The tube includes an interior surface and an exterior surface and is positioned in the container. The lid is coupled to the container. The lid includes an upper surface, a lower surface, a region extending between the lower surface and the upper surface, and an aperture that extends through the lid. The lid is movable between a closed position where the lid covers the open bottom end and an open position for emptying the container through the open bottom end. The first chamber is defined at least partially by the lid, the exterior surface of the tube, and the interior surface of the container when the lid is in the closed position. The second chamber is at least partially defined by the lid and the interior surface of the tube when the lid is in the closed position. The seal is coupled to the lid and includes a flange, an intermediate portion extending from the flange, and a post that extends from the flange. The post extends into the aperture of the lid to couple the seal to the lid. The seal is positioned between the lid and the tube when the lid is in the closed position to inhibit airflow between the first chamber and the second chamber.

The present invention provides, in another aspect, a dirt cup for use in a vacuum cleaner. The dirt cup includes a container, a tube, a lid, a first chamber, a second chamber, and a seal. The container includes an interior surface and an open bottom end. The tube includes an interior surface, an exterior surface, and a frustoconical bottom portion. The tube is positioned in the container. The lid is coupled to the container. The lid includes a lower surface, an upper surface, and a frustoconical region extending between the lower surface and the upper surface. The lid is movable between a closed position where the lid covers the open bottom end and an open position for emptying the container through the open bottom end. The first chamber is at least partially defined by the lid, the exterior surface of the tube, and the interior surface of the container when the lid is in the closed position. The second chamber is at least partially defined by the lid and the interior surface of the tube when the lid is in the closed position. The seal is coupled to the lid and includes a flange and a frustoconical intermediate portion extending from the flange. The frustoconical intermediate portion of the seal is positioned between the frustoconical region and the frustoconical bottom portion of the tube when the lid is in the closed position to inhibit airflow between the first chamber and the second chamber when the lid is in the closed position.

The present invention provides, in another aspect, a dirt cup for use in a vacuum cleaner. The dirt cup includes a container, a tube, a lid, a first chamber, a second chamber, and a seal. The container includes an interior surface and an open bottom end. The tube includes an interior surface and an exterior surface. The tube is positioned in the container. The lid is coupled to the container. The lid includes a lower surface, an upper surface, a region extending between the lower surface and the upper surface. The lid is movable between a closed position where the lid covers the open bottom end and an open position for emptying the container through the open bottom end. The first chamber is at least partially defined by the lid, the exterior surface of the tube, and the interior surface of the container when the lid is in the closed position. The second chamber is at least partially defined by the lid and the interior surface of the tube when the lid is in the closed position. The seal includes a seal projection that is convex and resilient. The seal is coupled to the lid and is positioned between the lid and the tube when the lid is in the closed position. The seal inhibits airflow between the first chamber and the second chamber when the lid is in the closed position.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
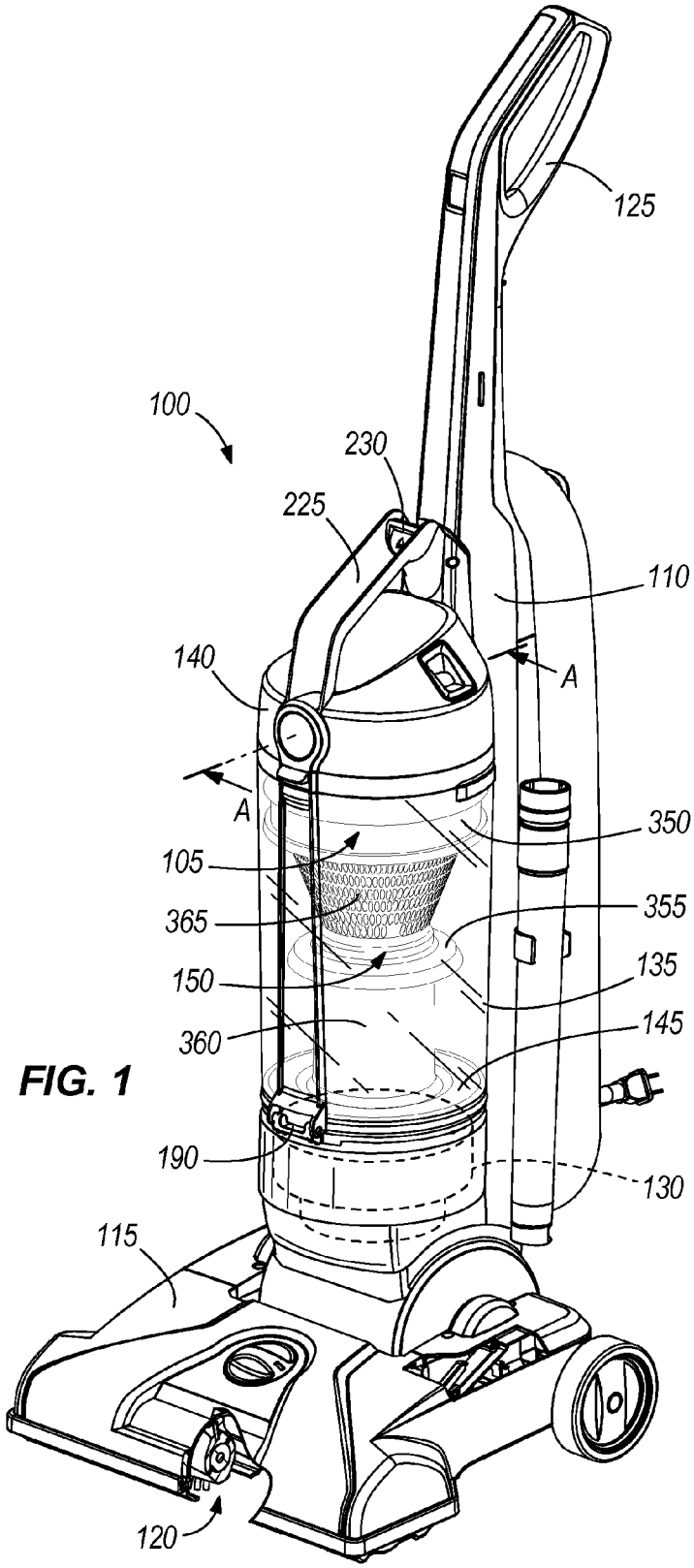
FIG. 1 is a perspective view of a vacuum cleaner.

FIG. 1 illustrates a vacuum cleaner 100 that includes a dirt cup assembly 105 detachably secured to a body 110, a foot 115 including a suction nozzle 120, a handle 125, and a suction source 130. The suction source 130 can be a motor and fan assembly or other suitable structure for creating a vacuum. The vacuum cleaner 100 is shown as an upright cyclonic vacuum cleaner. Alternatively, the vacuum cleaner 100 can be of other types, including a canister vacuum cleaner and a central vacuum cleaner.

Figure 2:
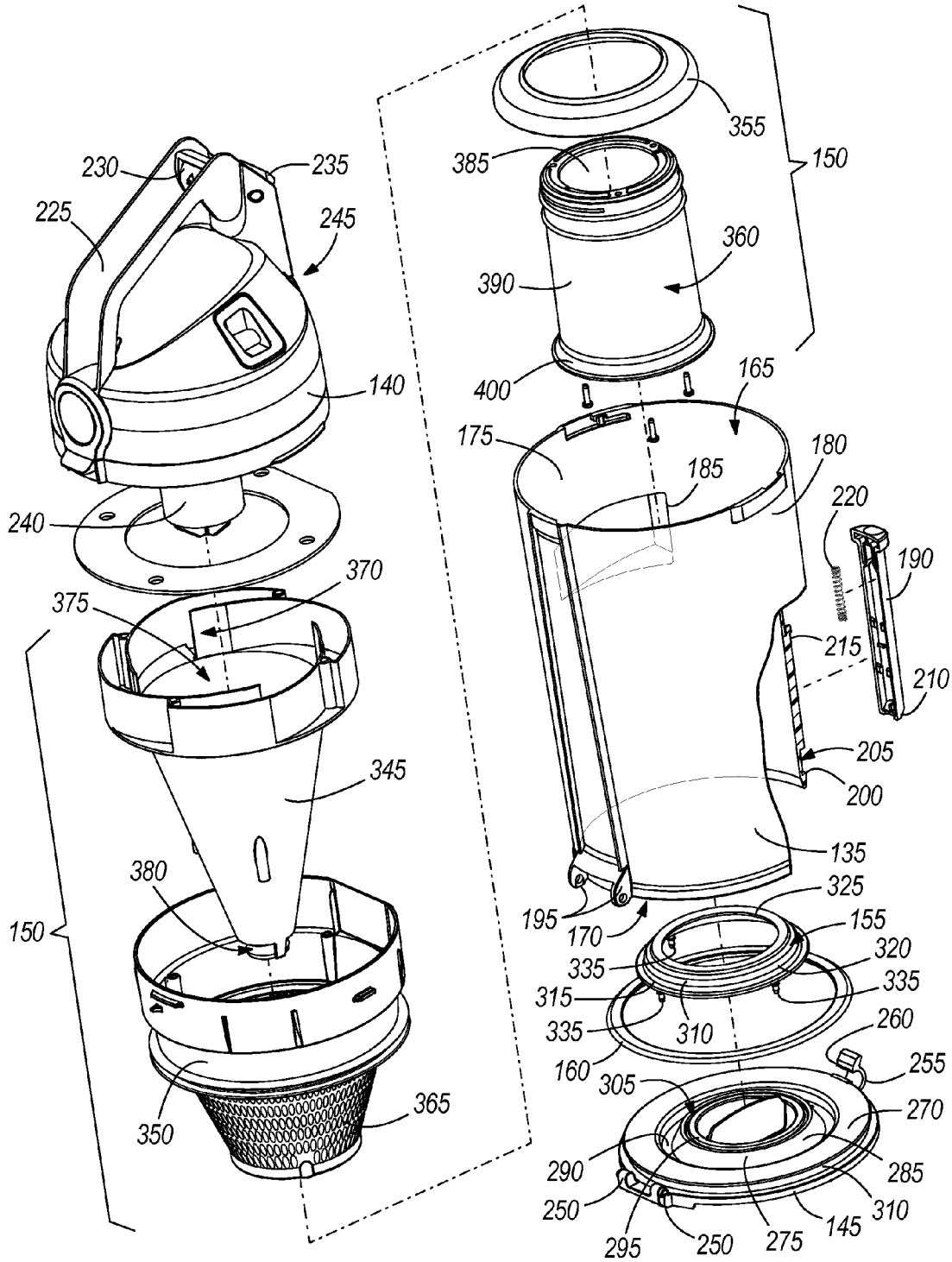
FIG. 2 is an exploded view of a dirt cup assembly of the vacuum cleaner of FIG. 1.

As shown in FIG. 2, the dirt cup assembly 105 includes a cylindrical container 135, a cover 140, a bottom lid 145, a cyclone assembly 150, an inner seal 155, and an outer seal 160. The container 135 includes an open top end 165, an open bottom end 170, an interior surface 175, an exterior surface 180, a tangential air inlet 185, a lever 190, two hinge tabs 195, and a locking lip 200 formed by an locking aperture 205 extending into the container 135. The lever 190 includes an actuator 210 and slides along a track 215 formed on the exterior surface 180. A spring 220 biases the lever 190 toward the top end 165. Preferably, the container 135 is made of substantially transparent plastic. Alternatively, the container 135 can be other shapes.

The cover 140 is detachably secured to the container 135 at the top end 165. The cover 140 is secured by a twist-lock or other suitable relationship between the cover 140 and the container 135. The cover 140 includes a handle 225 and a release switch 230 with a locking protrusion 235. The release switch 230 detachably secures the dirt cup assembly 105 to the body 110. The locking protrusion 235 engages a corresponding locking lip on the body 110 when the release switch 230 is in a locked position. In an unlocked position, the locking protrusion 235 does not engage the locking lip, thereby allowing the dirt cup assembly 105 to be detached from the body 110. The cover 140 also includes an cyclone exhaust tube 240 fluidly connected to an air outlet 245. A filter can be positioned at the cyclone exhaust tube 240, at the air outlet 245, or in-between the cyclone exhaust tube 240 and the air outlet 245.

The lid 145 includes two hinge posts 250 and a latch arm 255 with a locking protrusion 260. The lid 145 is pivotally connected to the container 135 by a hinge 265 located near the bottom end 170. Each hinge post 250 pivotally engages the corresponding hinge tab 195 extending from the container 135 to form the hinge 265. The lid 145 pivots about the hinge 265 between a closed position (shown in FIG. 3) and a number of open positions (shown in FIG. 4). Alternatively, other hinge structures can be used to pivotally connect the lid 145 to the container 135.

Figure 6:
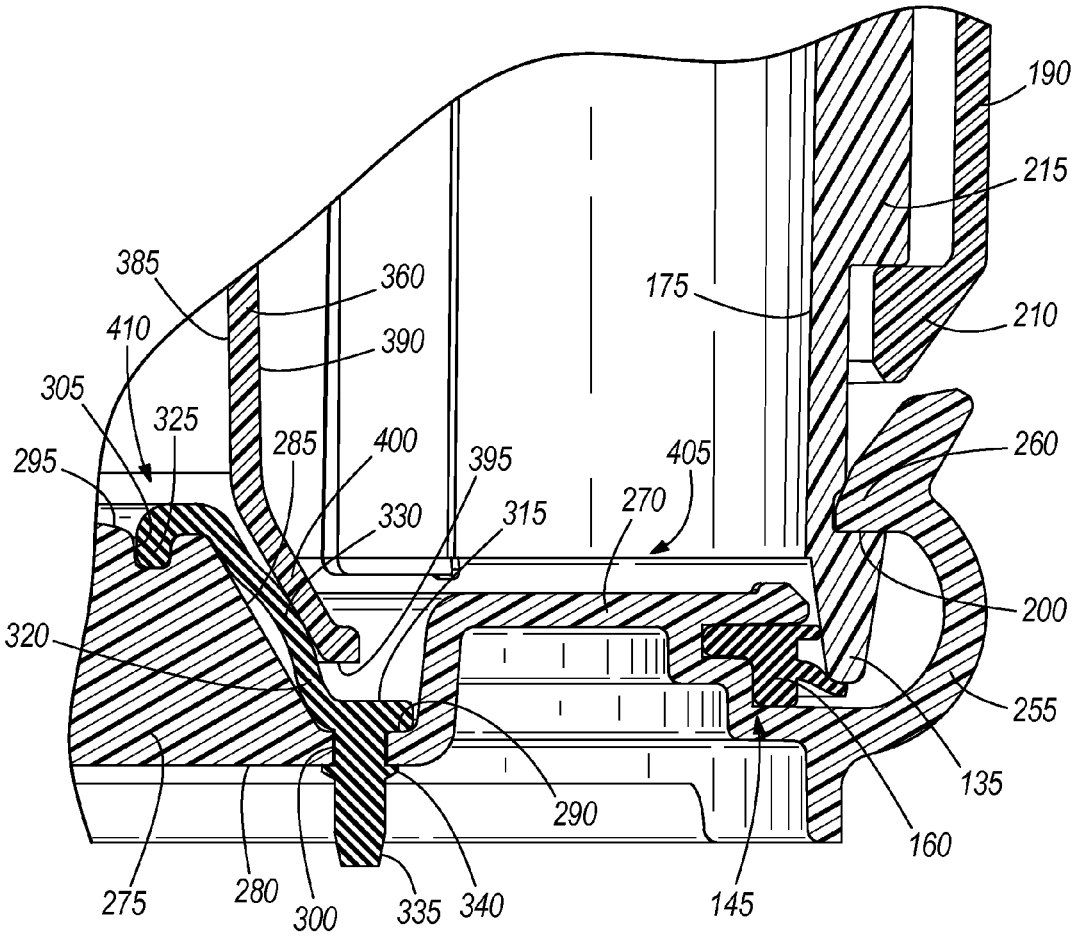
FIG. 6 is an enlarged sectional view of a portion of the dirt cup assembly of FIG. 5 with the lid in the closed position.
Figure 7:
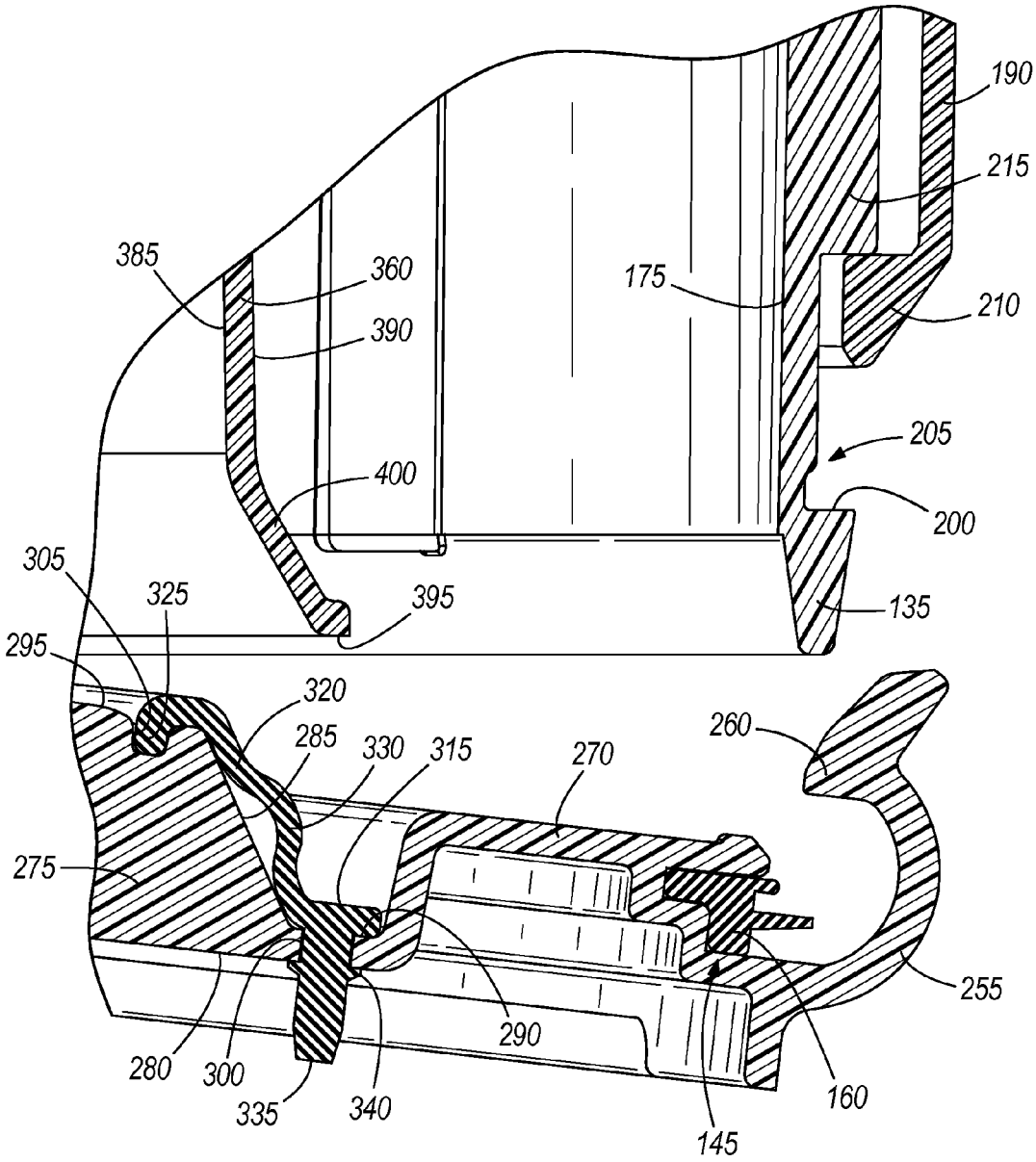
FIG. 7 is an enlarged sectional view of a portion of the dirt cup assembly of FIG. 5 with the lid in the open position.

As shown in FIGS. 2 and 6, the lid 145 also includes an outer region 270, a central region 275, and an outer surface 280 (shown in FIG. 6). The central region 275 is substantially frustoconical in shape and includes an angled surface 285 that extends from a lower surface 290 to a top surface 295. Multiple apertures 300 (shown in FIG. 6) are formed through the lid 145. A channel 305 is recessed into the top surface 295. An annular recess 310 (shown in FIG. 2) is formed at the periphery of the lid 145 in the side of the outer region 270.

As shown in FIGS. 2 and 6, the inner seal 155 (shown in FIG. 2) includes an outer flange 315, an intermediate portion 320, and an inner protrusion 325. The inner seal 155 is substantially frustoconical in shape. The intermediate portion 320 is angled relative to the outer flange 315 and includes a convex seal projection 330 (shown in FIG. 6). The seal projection 330 curves away from the angled surface 285 of the lid 145. Multiple posts 335 extend downwardly from the bottom of the outer flange 315. Each post 335 extends through one of the apertures 300 (shown in FIG. 6) of the lid 145 to secure the inner seal 155 to the lid 145. Each post 335 includes a rib 340 (shown in FIG. 6) that contacts the outer surface 280 (shown in FIG. 6) of the lid 145. The channel 305 receives the inner protrusion 325 in a press fit, snap fit, or other suitable manner to secure the inner seal 155 to the lid 145. The recess 310 (shown in FIG. 2) receives the outer seal 160 in a press fit, snap fit, or other suitable manner to secure the outer seal 160 to the lid 145. Preferably, the inner seal 155 and the outer seal 160 are made from rubber or another resilient material.

Figure 5:
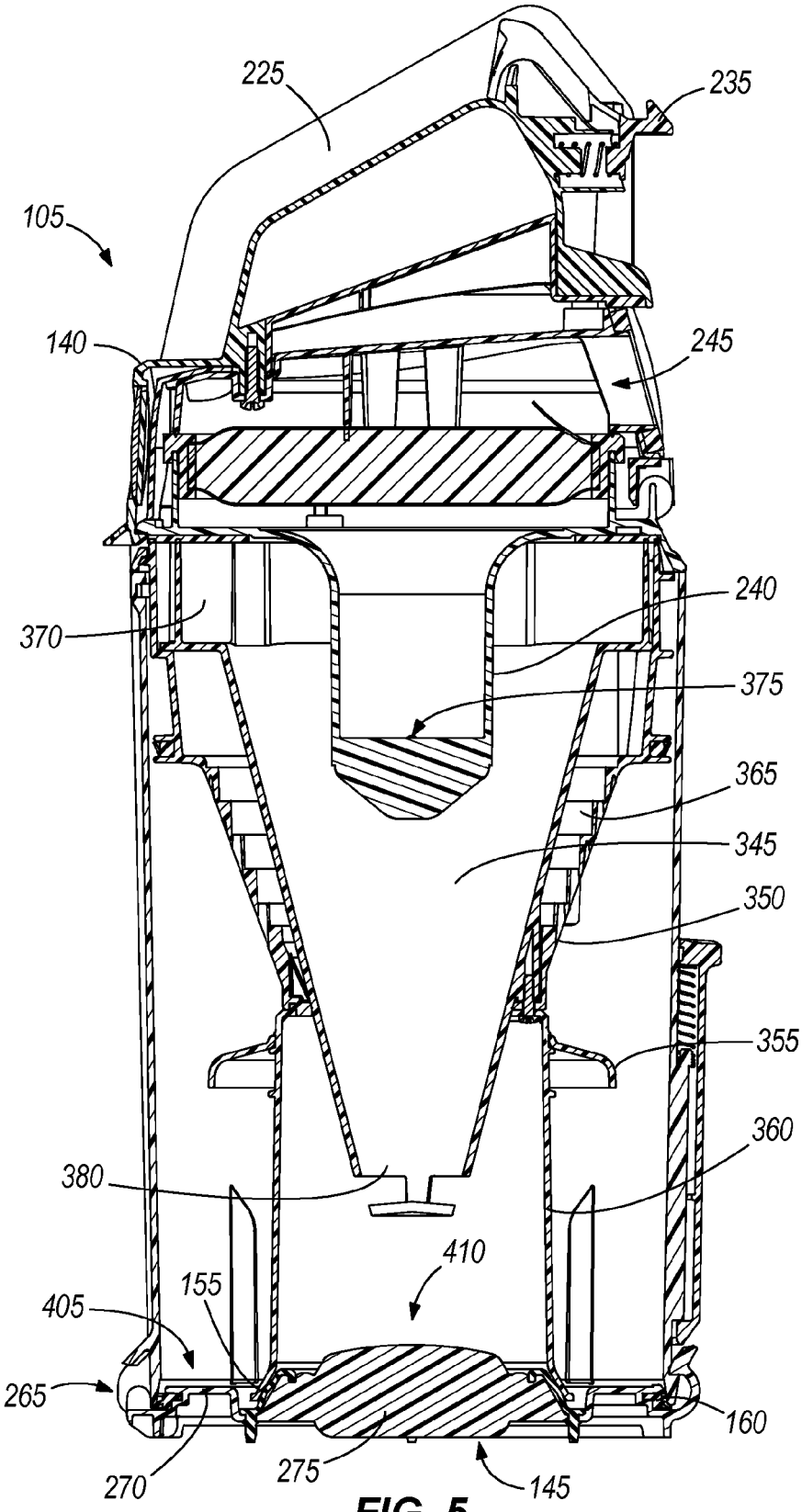
FIG. 5 is a sectional view of the dirt cup assembly along line A-A of FIG. 1.

As shown in FIGS. 2 and 5, the cyclone assembly 150 includes a frustoconical cyclone 345, a shroud 350, a skirt 355, and a support tube or tube 360. The shroud 350 is secured to the container 135 at or near the top end 165. The lower portion of the shroud 350 is secured to the upper portion of the tube 360. The skirt 355 extends radially outward from the upper portion of the tube 360. The shroud 350 includes a perforated section 365 located above the skirt 355. The cyclone 345 nests within the assembly of the shroud 350, the skirt 355, and the tube 360. The cyclone 345 includes an air inlet 370, an air outlet 375, and a dirt outlet 380. The tube 360 includes an interior surface 385, an exterior surface 390, a bottom surface 395, and an angled bottom portion 400. The bottom portion 400 is substantially frustoconical in shape. Alternatively, the cyclone assembly 150 could include multiple cyclones 345 arranged in series or in parallel with each other.

As shown in FIG. 5, a first dirt collection chamber 405 is at least partially defined by the lid 145 in the closed position, the exterior surface 390 of the tube 360, and the interior surface 175 of container 135. A second dirt collection chamber 410 is at least partially defined by the lid 145 in the closed position and the interior surface 385 of the tube 360

The angled bottom portion 400 of the tube 360 contacts the intermediate portion 320 of the inner seal 155 along the angled surface 285 of the central region 275 of the lid 145 and the bottom surface 395 contacts or is positioned adjacent to the outer flange 315 of the inner seal 155 when the lid 145 is in the closed position. This forms a seal between the lid 145 and the tube 360 that prevents air from flowing between the first dirt collection chamber 405 and the second dirt collection chamber 410 near the lid 145. The outer seal 160 contacts the inner wall of the container 135 when the lid 145 is in the closed position to create a seal that prevents air from flowing from the first dirt collection chamber 405 to the exterior of the container 135 near the lid 145.

Figure 3:
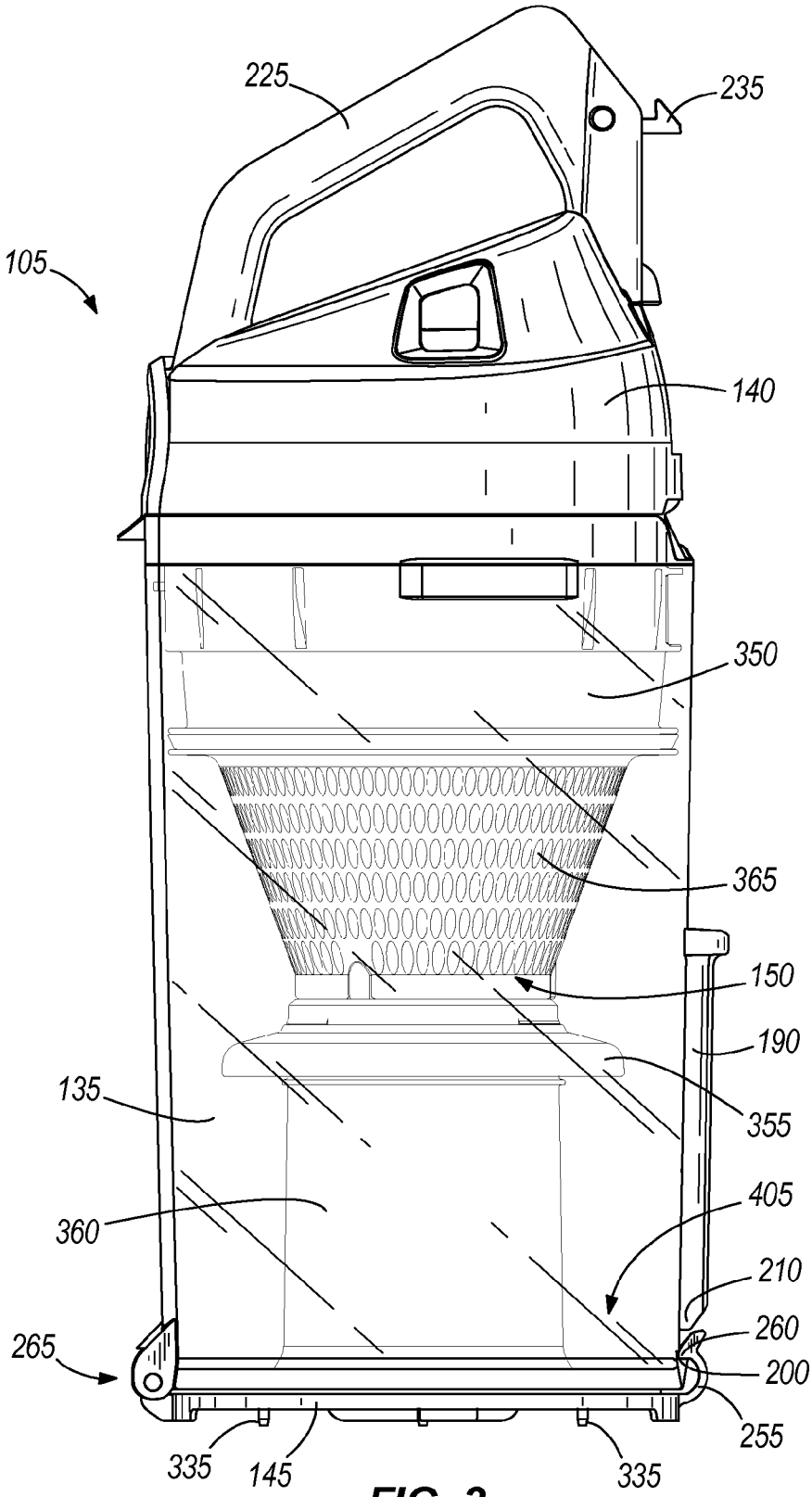
FIG. 3 is a side view of the dirt cup assembly of FIG. 2 with a lid in a closed position.
Figure 4:
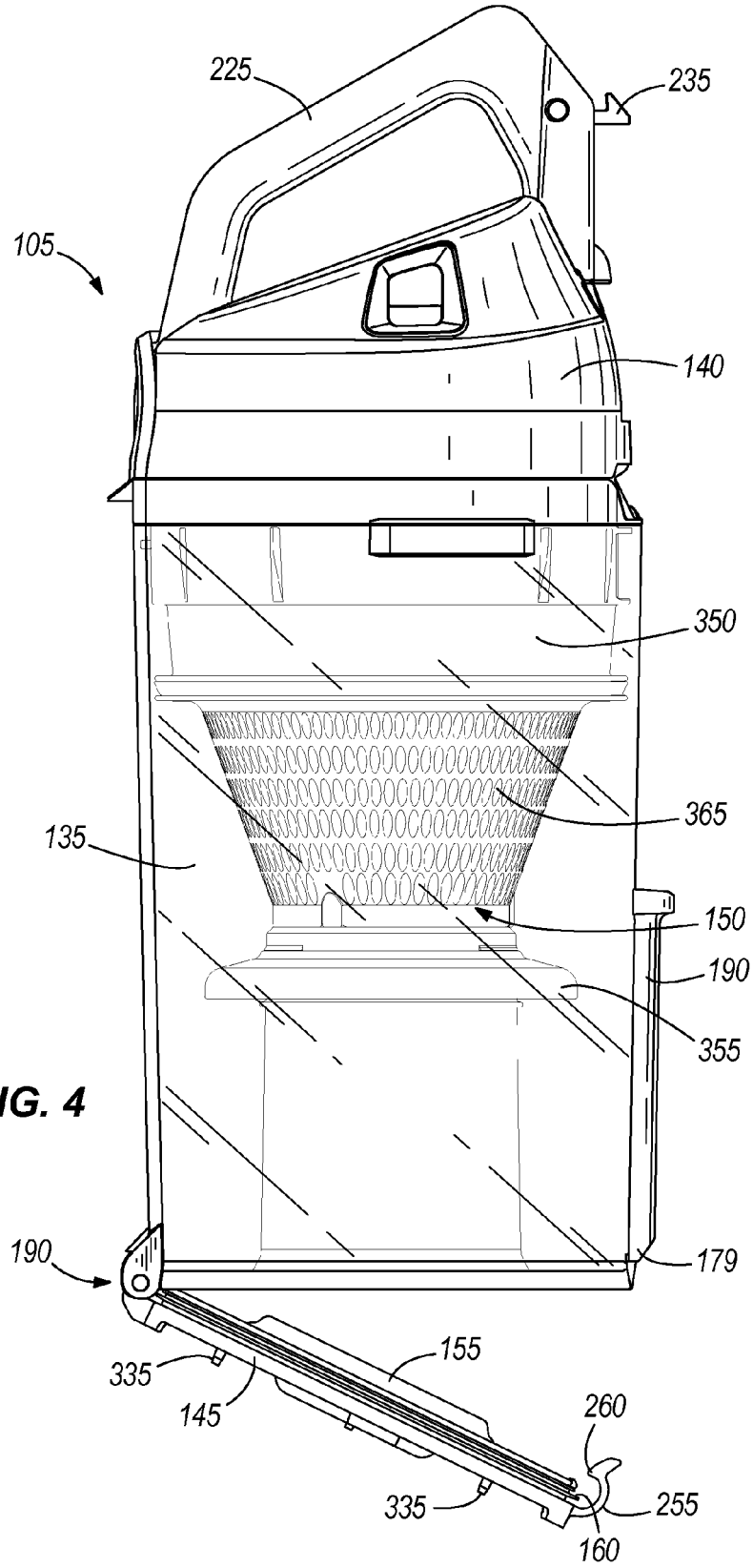
FIG. 4. is a side view of the dirt cup assembly of FIG. 2 with the lid in an open position.

As shown in FIGS. 3 and 4, the lid 145 is secured in the closed position by the latch arm 255. In a locked position (shown in FIG. 3), the locking protrusion 260 of the latch arm 255 is engaged by the locking lip 200 to prevent the lid 145 from pivoting about the hinge 265. In an unlocked position (shown in FIG. 4), the locking protrusion 260 is not engaged by the locking lip 200 and the lid 145 is free to pivot about the hinge 265. To unlock the latch arm 255, the lever 190 is pushed down to a lowered position (shown in FIG. 4), where the actuator 210 pushes the locking protrusion 260 out of engagement with the locking lip 200 to move the latch arm 255 from the locked position to the unlocked position. When the lid 145 is in the closed position, the seal projection 330 is compressed between the angled surface 285 of the lid 145 and the angled bottom portion 400 of the tube 360 to bias the lid 145 toward the open position. This biasing force helps to move the lid 145 from the closed position toward the open position when the latch arm 255 is unlocked. The spring 220 returns the lever 190 to a raised position (shown in FIG. 3). The lid 145 is resecured in the closed position by pivoting the lid 145 about the hinge 265 until the latch arm 255 snaps into the locked position.

During use of the vacuum cleaner 100, the suction source 130 draws dirty air through the suction nozzle 120 to the tangential air inlet 185 in the container 135. The dirty air enters the dirt cup assembly 105 through the tangential air inlet 185 and is swirled in a cyclonic manner between the interior surface 175 of the container 135 and the cyclone assembly 150. This cyclonic action separates relatively large dirt particles from the dirty air. These relatively large dirt particles are collected in the first dirt collection chamber 405. The partially cleaned air flows through the perforated section 365 of the shroud 350 to the cyclone air inlet 370. The partially cleaned air is swirled in a cyclonic manner within the cyclone 345. This cyclonic action separates relatively small dirt particles from the partially cleaned air. These relatively small dirt particles exit the cyclone 345 through the dirt outlet 380 and are collected in the second dirt collection chamber 410. The cleaned air passes through the cyclone air outlet 375 to the cyclone exhaust tube 240, then through the cover air outlet 245 to the suction source 130, and is finally exhausted from the vacuum cleaner 100.

To empty the dirt cup assembly 105, the dirt cup assembly 105 is released from the body 110 by sliding the release switch 230 from the locked position to the unlocked position. Then, the dirt cup assembly 105 is detached from the body 110. The dirt cup assembly 105 is then positioned above a trash can or other waste container and the lid 145 is opened to empty the dirt collected in the first dirt collection chamber 405 and the second dirt collection chamber 410 into the trash can. After the dirt cup assembly 105 is emptied, the lid 145 is returned to the closed position and the dirt cup assembly 105 is secured to the body 110.

Various features of the invention are set forth in the following claims.

What is claimed is:

1. A dirt cup for use in a vacuum cleaner, the dirt cup comprising:

a container including an interior surface and an open bottom end;

a tube including an interior surface and an exterior surface, the tube positioned in the container;

a lid coupled to the container, the lid including an upper surface, a lower surface, a region extending between the lower surface and the upper surface, and an aperture that extends through the lid, the lid movable between a closed position where the lid covers the open bottom end and an open position for emptying the container through the open bottom end;

a first chamber at least partially defined by the lid, the exterior surface of the tube, and the interior surface of the container when the lid is in the closed position;

a second chamber at least partially defined by the lid and the interior surface of the tube when the lid is in the closed position; and a seal coupled to the lid and including a flange, an intermediate portion extending from the flange, and a post that extends from the flange, the post extending into the aperture of the lid to couple the seal to the lid;

wherein the seal is positioned between the lid and the tube when the lid is in the closed position to inhibit airflow between the first chamber and the second chamber.

2. The dirt cup of claim 1, wherein the post includes a rib, wherein the lid includes an outer surface, and wherein the post extends through the aperture and the rib contacts the outer surface to couple the seal to the lid.

3. The dirt cup of claim 1, wherein the lid includes an outer periphery, the dirt cup further comprising:

a second seal secured at the outer periphery of the lid, the second seal contacting the interior surface of the container when the lid is in the closed position to inhibit air flow between the first chamber and the exterior of the container.

4. The dirt cup of claim 1, wherein the region of the lid includes an angled surface between the lower surface and the upper surface so that the region is substantially frustoconical in shape, wherein the intermediate portion of the seal is angled relative to the flange so that the seal is substantially frustoconical in shape, and wherein the tube includes a bottom portion angled outwardly from the exterior surface of the tube so that the bottom portion is substantially frustoconical in shape, and wherein the intermediate portion of the seal is positioned between the angled surface of the region and the bottom portion of the tube when the lid is in the closed position.

5. The dirt cup of claim 4, wherein the intermediate portion of the seal includes a seal projection that is convex and resilient, the seal projection compressed between the angled surface of the region and the bottom portion of tube when the lid is in the closed position.

6. The dirt cup of claim 1, wherein the intermediate portion of the seal includes a convex seal projection that is compressed between the lid and the tube when the lid is in the closed position.

7. The dirt cup of claim 1, wherein the lid further includes a channel formed in the upper surface, wherein the seal further includes a protrusion, the intermediate portion extending between the flange, and wherein the protrusion and the protrusion is received by the channel.

8. A dirt cup for use in a vacuum cleaner, the dirt cup comprising:

a container including an interior surface and an open bottom end;

a tube including an interior surface, an exterior surface, and a frustoconical bottom portion, the tube positioned in the container;

a lid coupled to the container, the lid including a lower surface, an upper surface, and a frustoconical region extending between the lower surface and the upper surface, the lid movable between a closed position where the lid covers the open bottom end and an open position for emptying the container through the open bottom end;

a first chamber at least partially defined by the lid, the exterior surface of the tube, and the interior surface of the container when the lid is in the closed position;

a second chamber at least partially defined by the lid and the interior surface of the tube when the lid is in the closed position; and a seal coupled to the lid and including a flange and a frustoconical intermediate portion extending from the flange;

wherein the frustoconical intermediate portion of the seal is positioned between the frustoconical region and the frustoconical bottom portion of the tube when the lid is in the closed position to inhibit airflow between the first chamber and the second chamber when the lid is in the closed position.

9. The dirt cup of claim 8, wherein the lid further includes an aperture that extends through the lid and wherein the seal further includes a post that extends from the flange and into the aperture to couple the seal to the lid.

10. The dirt cup of claim 9, wherein the post includes a rib, wherein the lid includes an outer surface, and wherein the post extends through the aperture and the rib contacts the outer surface to couple the seal to the lid.

11. The dirt cup of claim 8, wherein the lid includes an outer periphery, the dirt cup further comprising:

a second seal secured at the outer periphery of the lid, the second seal contacting the interior surface of the container when the lid is in the closed position to inhibit air flow between the first chamber and the exterior of the container.

12. The dirt cup of claim 8, wherein the intermediate portion of the seal includes a seal projection that is convex and resilient, the seal projection compressed between the frustoconical region and the bottom portion of tube when the lid is in the closed position.

13. The dirt cup of claim 8, wherein the lid further includes a channel formed in the upper surface and the seal further includes a protrusion so that the intermediate portion extends between the flange and the protrusion is received by the channel.

14. A dirt cup for use in a vacuum cleaner, the dirt cup comprising:

a container including an outer wall and an open bottom end, the outer wall including an interior surface;

a tube including an interior surface and an exterior surface, the tube positioned in the container;

a lid coupled to the container, the lid including a lower surface, an upper surface, an outer periphery, and a region extending between the lower surface and the upper surface, the lid movable between a closed position where the lid covers the open bottom end and an open position for emptying the container through the open bottom end;

a first chamber at least partially defined by the lid, the exterior surface of the tube, and the interior surface of the container when the lid is in the closed position;

a second chamber at least partially defined by the lid and the interior surface of the tube when the lid is in the closed position; and a first seal including a seal projection that is convex and resilient, the first seal coupled to the lid and positioned between the lid and the tube when the lid is in the closed position;

a second seal secured at the outer periphery of the lid, the second seal contacting the interior surface of the outer wall of the container when the lid is in the closed position to inhibit air flow between the first chamber and an exterior of the container, wherein the first seal inhibits airflow between the first chamber and the second chamber when the lid is in the closed position.

15. The dirt cup of claim 14, wherein the seal projection is compressed between the lid and the tube when the lid is in the closed position.

16. The dirt cup of claim 15, wherein the lid further includes a latch arm, wherein the container further includes a lip, and wherein in a locked position the latch arm engages the lip to lock the lid in the closed position.

17. The dirt cup of claim 16, wherein the seal projection biases the lid toward the open position when the lid is in the closed position.

18. The dirt cup of claim 17, wherein the lid further includes an aperture that extends through the lid and wherein the first seal further includes a post that extends from the flange and into the aperture to couple the first seal to the lid.

19. The dirt cup of claim 18, wherein the post includes a rib, wherein the lid includes an outer surface, and wherein the post extends through the aperture and the rib contacts the outer surface to couple the seal to the lid.

20. A dirt cup for use in a vacuum cleaner, the dirt cup comprising:

a container including an interior surface and an open bottom end;

a tube including an interior surface, an exterior surface, and a frustoconical bottom portion, the tube positioned in the container;

a lid coupled to the container, the lid including a lower surface, an upper surface, and a frustoconical region extending between the lower surface and the upper surface, the lid movable between a closed position where the lid covers the open bottom end and an open position for emptying the container through the open bottom end;

a first chamber at least partially defined by the lid, the exterior surface of the tube, and the interior surface of the container when the lid is in the closed position;

a second chamber at least partially defined by the lid and the interior surface of the tube when the lid is in the closed position; and a seal coupled to the lid and including a flange and a frustoconical intermediate portion extending from the flange, wherein the frustoconical intermediate portion of the seal is positioned between the frustoconical region and the frustoconical bottom portion of the tube when the lid is in the closed position to inhibit airflow between the first chamber and the second chamber when the lid is in the closed position, and wherein the lid further includes a channel formed in the upper surface and the seal further includes a protrusion so that the intermediate portion extends between the flange and the protrusion is received by the channel.

21. A dirt cup for use in a vacuum cleaner, the dirt cup comprising:

a container including an interior surface and an open bottom end;

a tube including an interior surface and an exterior surface, the tube positioned in the container;

a lid coupled to the container, the lid including a lower surface, an upper surface, and a region extending between the lower surface and the upper surface, the lid movable between a closed position where the lid covers the open bottom end and an open position for emptying the container through the open bottom end;

a first chamber at least partially defined by the lid, the exterior surface of the tube, and the interior surface of the container when the lid is in the closed position;

a second chamber at least partially defined by the lid and the interior surface of the tube when the lid is in the closed position; and a seal including a seal projection that is convex and resilient, the seal coupled to the lid and positioned between the lid and the tube when the lid is in the closed position, wherein the seal inhibits airflow between the first chamber and the second chamber when the lid is in the closed position, wherein the seal projection is compressed between the lid and the tube when the lid is in the closed position, wherein the lid further includes a latch arm, wherein the container further includes a lip, and wherein in a locked position the latch arm engages the lip to lock the lid in the closed position, wherein the seal projection biases the lid toward the open position when the lid is in the closed position, wherein the lid further includes an aperture that extends through the lid and wherein the seal further includes a post that extends from the flange and into the aperture to couple the seal to the lid.

22. The dirt cup of claim 21, wherein the post includes a rib, wherein the lid includes an outer surface, and wherein the post extends through the aperture and the rib contacts the outer surface to couple the seal to the lid.

* * * * *